US007104168B2

(12) United States Patent
Hsien

(10) Patent No.: US 7,104,168 B2
(45) Date of Patent: Sep. 12, 2006

(54) SLIDE STOP DEVICE OF A HEXAGONAL SPANNER

(76) Inventor: Chih-Ching Hsien, 235 Chung-Ho Box 8-24, Taipei (TW)

( * ) Notice: Subject to any disclaimer, the term of this patent is extended or adjusted under 35 U.S.C. 154(b) by 142 days.

(21) Appl. No.: 10/867,318

(22) Filed: Jun. 15, 2004

(65) Prior Publication Data

US 2005/0274239 A1 Dec. 15, 2005

(51) Int. Cl.
*B25B 23/10* (2006.01)

(52) U.S. Cl. ..... 81/443; 81/448

(58) Field of Classification Search ..... 81/441–445, 81/447–449, 461

See application file for complete search history.

(56) References Cited

U.S. PATENT DOCUMENTS 1,058,454 A * 4/1913 Moores ..... 279/7
2,404,427 A * 7/1946 Bloomfield ..... 81/443
3,600,984 A * 8/1971 Bihlmaier ..... 81/2
4,696,102 A * 9/1987 Overbay ..... 29/726
4,724,608 A * 2/1988 Parrott ..... 29/724
5,025,688 A * 6/1991 Davis ..... 81/448
5,927,165 A * 7/1999 Vasudeva ..... 81/448

FOREIGN PATENT DOCUMENTS

JP 2005177968 A * 7/2005

* cited by examiner

*Primary Examiner*—David B. Thomas

(57) ABSTRACT

A slide stop device of a hexagonal spanner serves for preventing a rounded edged inner hexagonal screw to slide as the hexagonal spanner drives the inner hexagonal screw. The slide stop device comprises a spanner body; one end of the spanner body having a driving portion. The driving portion has at least one axial slot; a screw hole formed along an axial direction of driving portion; a through hole extending from an inner side of the screw hole and being at the same line with the screw hole; a screwing resisting element capable of being screwed into the screw hole; one end of the screwing resisting element having a driving hole so that an opening can be inserted into the cruciform hole to drive the screwing resisting element to rotate. In use, the screwing resisting element is inserted into the screw hole.

2 Claims, 7 Drawing Sheets

SLIDE STOP DEVICE OF A HEXAGONAL SPANNER

FIELD OF THE INVENTION

The present invention relates to spanners for driving hexagonal screws, and particular to a slide stop device of a hexagonal spanner.

BACKGROUND OF THE INVENTION

In general, if a screw is used for a longer time, the screw will round so that it is difficult to drive the screw by a spanner. Thereby, it is often that the screw must be destroyed for taking the screw out. This will destroy the work piece.

Thereby, to improve the defect in the prior art, there are some ways are developed for resolving the prior art problem.

However, all these improvements are aimed to improve outer hexagonal screws (that is, a screw has a hexagonal driving portion at an outer side of the screw) instead of improving inner hexagonal screws (that is, a screw has a hexagonal driving portion at an inner side of the screw).

This is because, referring to FIG. 7, the conventional spanner for driving an inner hexagonal screw has a solid structure with an L shape which does not deform. Each spanner is designed for screws with predetermined sizes. As the inner hexagonal screw has rounded edges so that as the hexagonal screw is driven, it will slide with respect to the spanner so that it can not be effectively driven.

However, for the outer hexagonal screws, the conventional spanner has expandable claming portions at two ends thereof so that as the edges of the hexagonal portion of an outer hexagonal screw are rounded, the clamping portions can deform to match the round edges of the outer hexagonal screws, but no this mechanism is design for the convention spanner for driving the inner hexagonal screws.

SUMMARY OF THE INVENTION

Accordingly, the primary object of the present invention is to provide a slide stop device of a hexagonal spanner for preventing a rounded edged inner hexagonal screw to slide as the hexagonal spanner drives the inner hexagonal screw; the slide stop device comprises a spanner body; one end of the spanner body having a driving portion. The driving portion has at least one axial slot; a screw hole formed along an axial direction of driving portion; a through hole extending from an inner side of the screw hole and being at the same line with the screw hole; a screwing resisting element capable of being screwing into the screw hole; one end of the screwing resisting element having a driving hole so that an opening can be inserted into the cruciform hole to drive the screwing resisting element to rotate. In use, the screwing resisting element is inserted into the screw hole.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
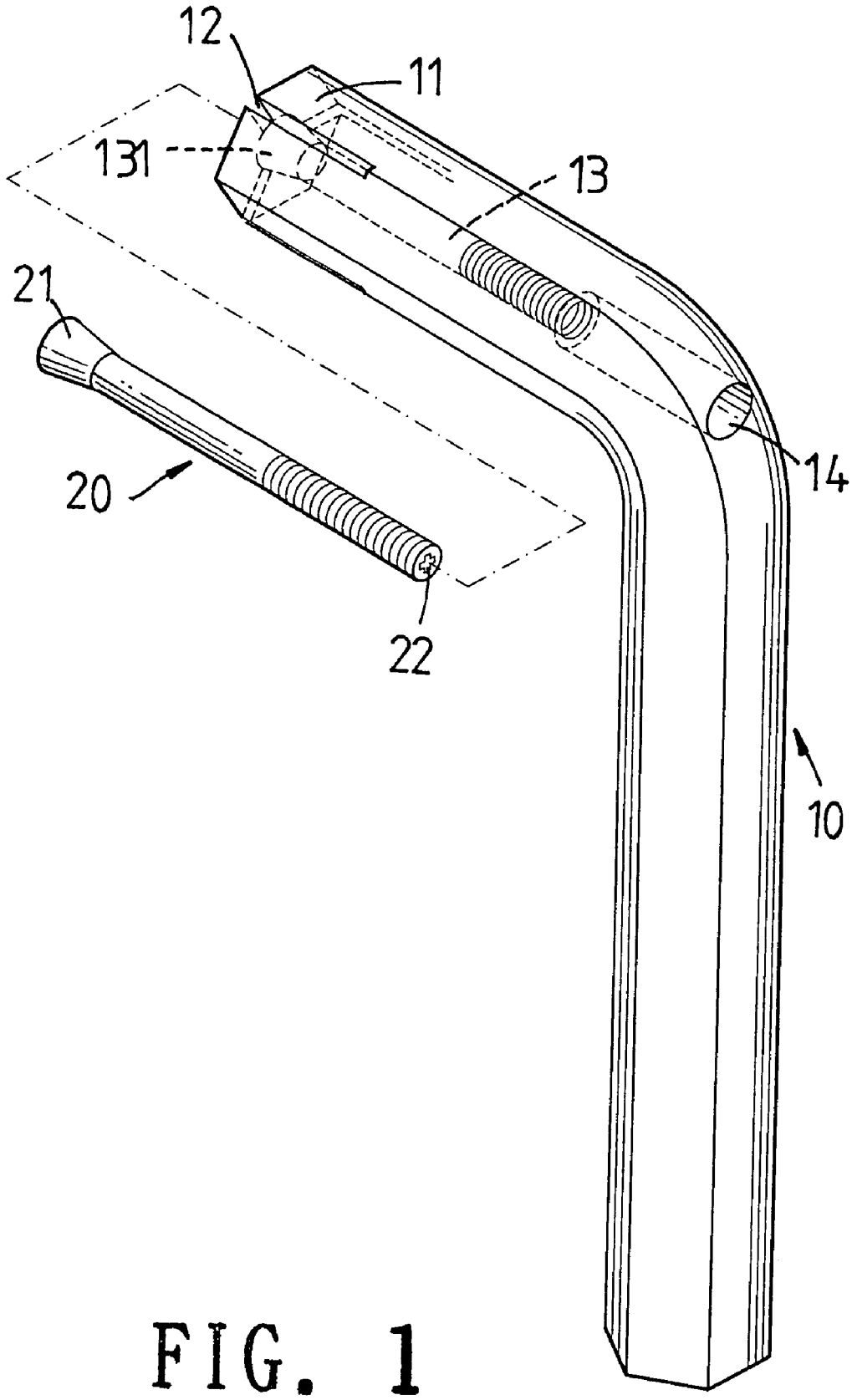
FIG. 1 is an exploded perspective view of a first embodiment of the slide stop device of a hexagonal spanner of the present invention.
Figure 2:
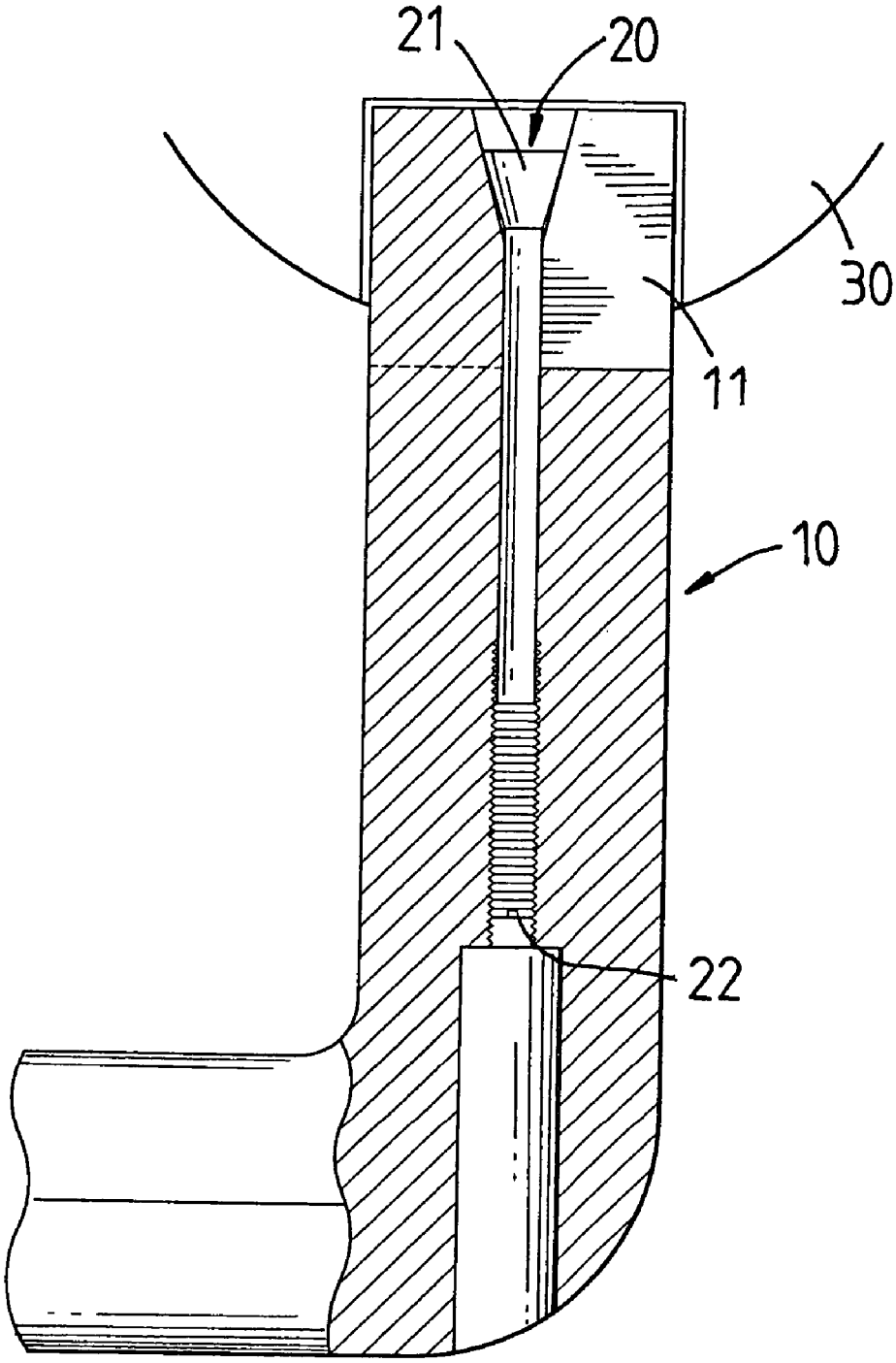
FIG. 2 shows one application of the slide stop device of a hexagonal spanner of the present invention.

With reference to FIGS. 1 and 2, the slide stop device of a hexagonal spanner of the present invention is illustrated. The slide stop device of a hexagonal spanner includes the following elements.

A spanner body 10 is enclosed. One end of the spanner body 10 has a driving portion 11. The driving portion 11 has three axial slots 12. Each, slot is extended from a center of one end surface of the driving portion 11 to apexes or lateral sides of a hexagonal cross section of the driving portion 11. A screw hole 13 is formed along an axial direction of driving portion 11. An outer end of the screw hole 12 in the axial center of the driving portion 11 has a tapered shape. A through hole 14 extends from an inner side of the screw hole 13 and is at the same line with the screw hole 13. The through hole 14 penetrates through a wall of the driving portion 11.

A screwing resisting element 20 has a shape matching the shape of the screw hole 13. Thus, a head end 21 of the screwing resisting element 20 has a tapered shape. The screwing resisting element 20 is capable of being screwing into the screw hole 13. Another end of the screwing resisting element 20 has a cruciform driving hole 22 so that an opening can be inserted into the cruciform hole to drive the screwing resisting element 20 to rotate. The screwing resisting element 20 serves for enforcing the driving portion 11 to deform.

In the hexagonal spanner of the present invention, a screw hole 13 is formed. By this space, the hexagonal spanner can deform from this portion so as to screw a loosely engaged inner hexagonal screw.

Figure 3:
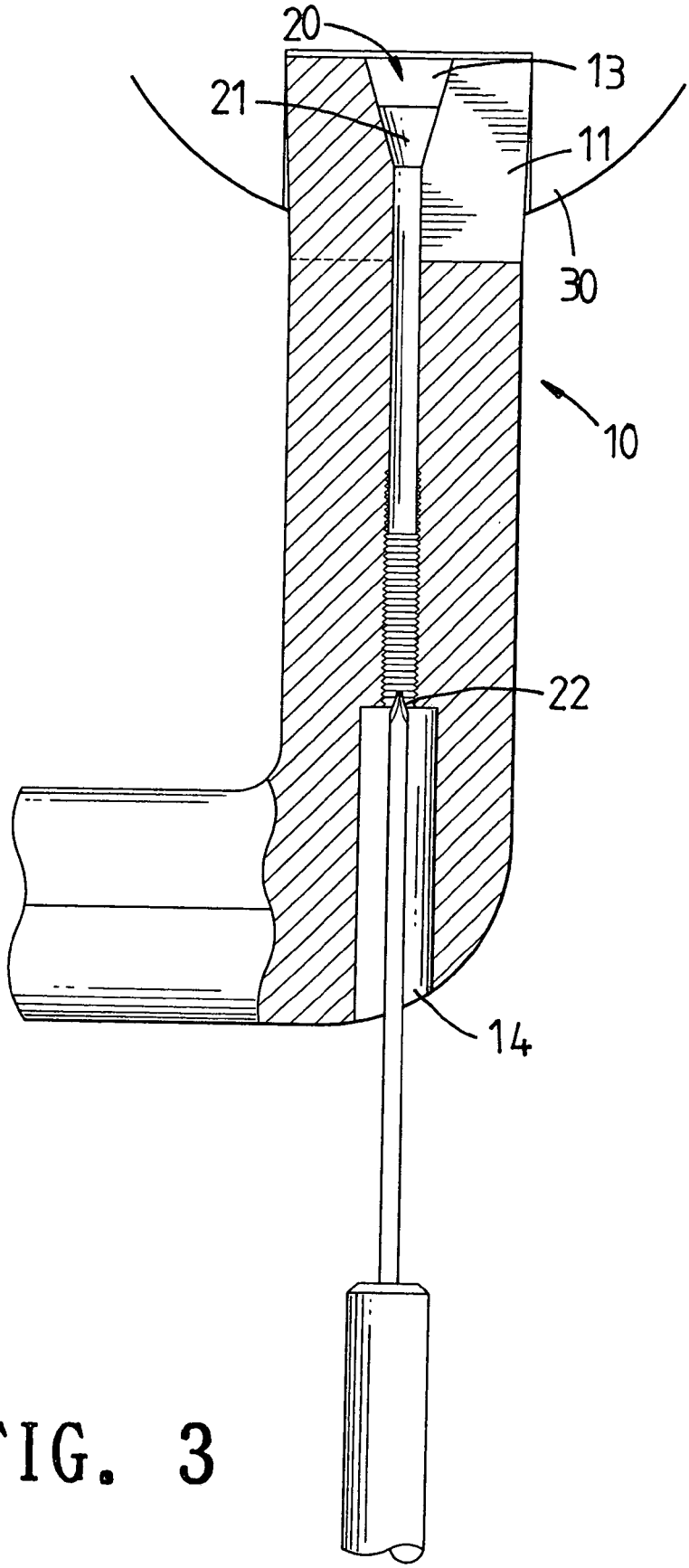
FIG. 3 shows a further application of the slide stop device of a hexagonal spanner of the present invention.

In use, referring to FIGS. 2 and 3, the screwing resisting element 20 is screwed into the screw hole 13 with the cruciform hole is at an inner side of the screw hole 13. When the spanner body 10 is placed in an inner side of an inner hexagonal screw 30, if initially, the hexagonal screw do not fully resist against the spanner body 10 due to, for example, the hexagonal screw 30 has rounded edges. A screw opener is inserted into the through hole 14 and then into the cruciform hole 22 for driving the screwing resisting element 20 to move further into the screw hole 13 so that the driving portion 11 can be expanded towards. Thereby, the driving portion 11 will tightly resist against a wall of the hexagonal screw 30. Moreover, in use of the hexagonal spanner, the expansion of the spanner body 10 can be adjusted as desired even the spanner body 10 is engaged with the inner hexagonal spanner.

Figure 4:
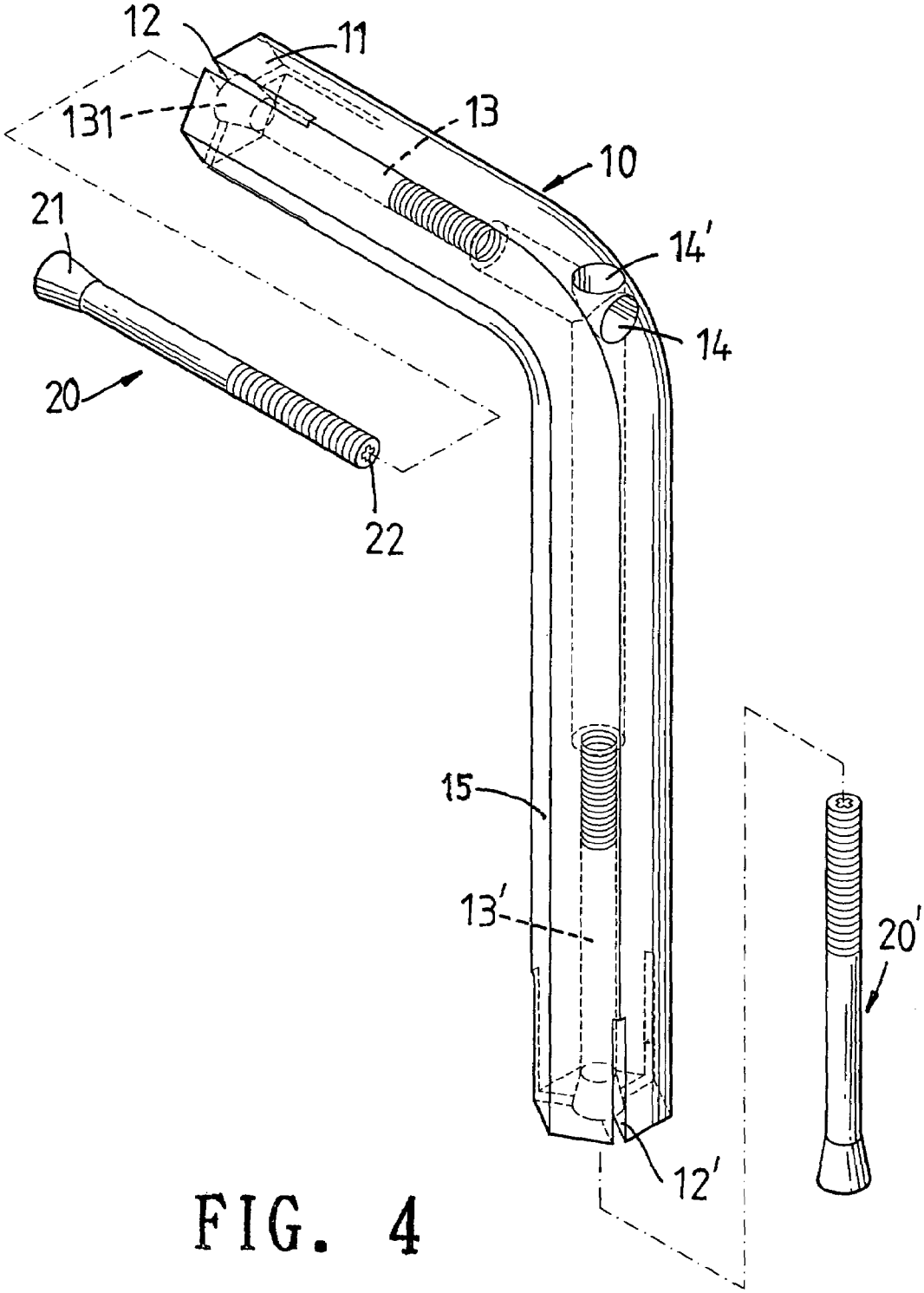
FIG. 4 shows the second embodiment of the slide stop device of a hexagonal spanner of the present invention.
Figure 5:
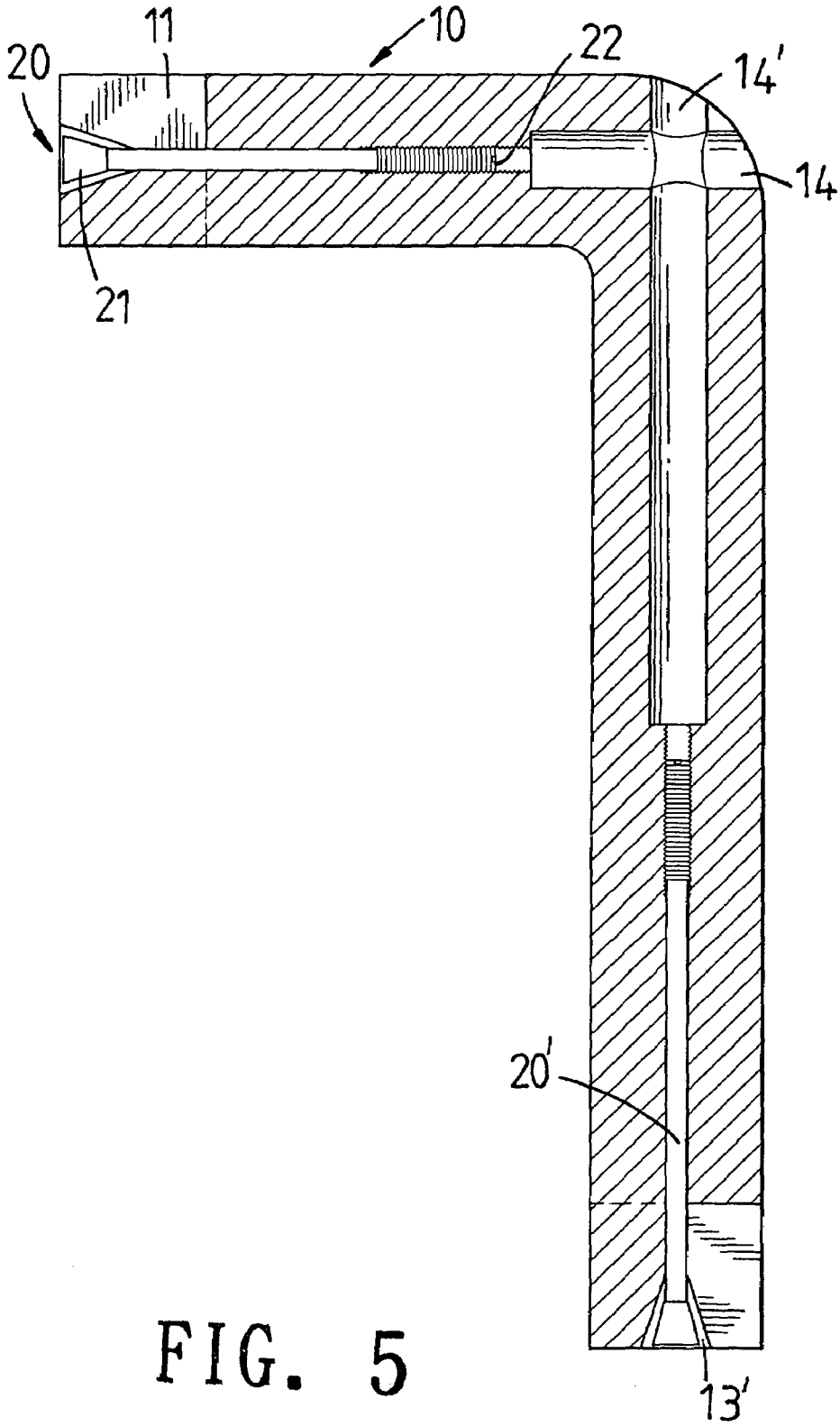
FIG. 5 shows the cross section view of the second embodiment according to the present invention.

Referring to FIGS. 4 and 5, the second preferred embodiment of the present invention is illustrated. It is illustrated that at another driving end 15 of the spanner body vertical the driving portion 11 has three axial slots 12'. Each slot is extended from a center of the driving end 15 to apexes or lateral sides of a hexagonal cross section of the driving end 15. A screw hole 13' is formed along an axial direction of driving end 15. An outer end of the screw hole 12' in the axial center of the driving end 15 has a tapered shape. A through hole 14' extends from an inner side of the screw hole 13' and is at the same line with the screw hole 13'. The through hole 14' penetrates through a wall of the driving end 15.

Figure 6:
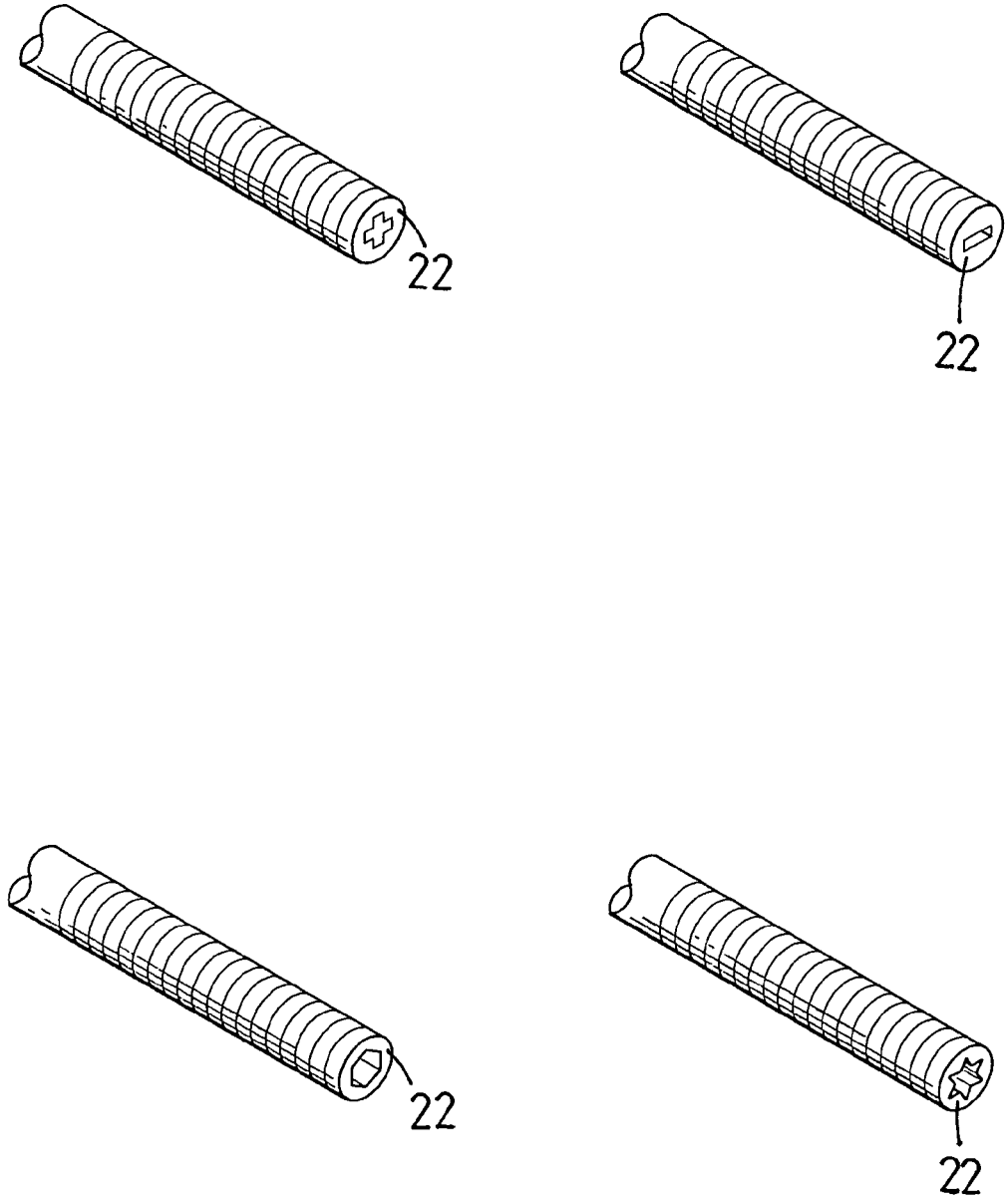
FIG. 6 shows the third embodiment of slide stop device of a hexagonal spanner of the present invention.
Figure 7:
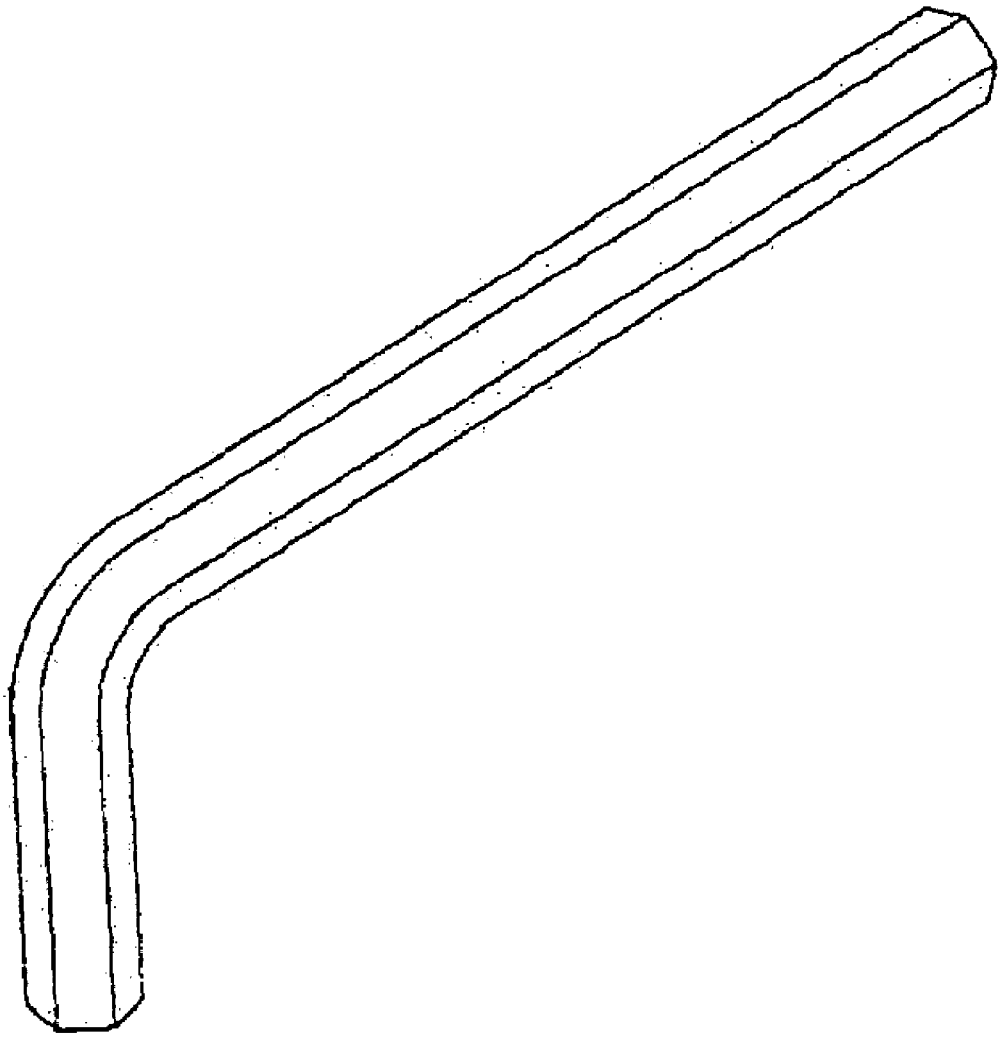
FIG. 7 PRIOR ART
FIG. 7 shows a perspective view of a perspective view hexagonal spanner.

Referring to FIG. 6, a third preferred embodiment of the present invention is illustrated. It is illustrated that in the driving hole 22, the screwing resisting element 20 may have a cruciform shape, a straight slot shape, a hexagonal shape, or a star shape. Thereby, a screw opening can be inserted into the hole for driving the screwing resisting element 20 into the screw hole 13.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A slide stop device of a hexagonal spanner for preventing a rounded edged inner hexagonal screw to slide as the hexagonal spanner drives the inner hexagonal screw; the slide stop device comprising:

a spanner body; one end of the spanner body having a driving portion; the driving portion having:

at least one axial slot; each slot being extended from a center of one end surface of the driving portion to apexes or lateral sides of a hexagonal cross section of the driving portion;

a screw hole formed along an axial direction of driving portion; an outer end of the screw hole in the axial center of the driving portion having a tapered shape;

a through hole extending from an inner side of the screw hole and being at the same line with the screw hole; the through hole penetrating through a wall of the driving portion;

a screwing resisting element having a shape matching the shape of the screw hole; a head end of the screwing resisting element having a tapered shape; the screwing resisting element being capable of being screwed into the screw hole; another end of the screwing resisting element having a driving hole; and wherein another end of the spanner body having a driving end; the driving portion having at least one second axial slot; each second slot being extended from a center of one end surface of the driving end to apexes or lateral sides of a hexagonal cross section of the driving end;

a second screw hole formed along an axial direction of driving end; an outer end of the second screw hole in the axial center of the driving end having a tapered shape;

a second through hole extending from an inner side of the second screw hole and being at the same line with the second screw hole; the second through hole penetrating through a wall of the second driving portion;

a second screwing resisting element having a shape matching the shape of the second screw hole; a head of the second screwing resisting element having a tapered shape; the second screwing resisting element being capable of being screwed into the second screw hole; one end of the second screwing resisting element having a second driving hole so that an opening can be inserted into the cruciform hole to drive the second screwing resisting element to rotate.

2. The slide stop device of a hexagonal spanner as claimed in claim 1, wherein the driving hole in the screwing resisting element has one of a cruciform shape, a straight slot shape, a hexagonal shape, and a star shape.

* * * * *